US006499497B1

(12) United States Patent
Swetish et al.

(10) Patent No.: US 6,499,497 B1
(45) Date of Patent: Dec. 31, 2002

(54) TENT WITH RETRACTABLE FLY

(75) Inventors: Thomas R. Swetish, Racine, WI (US); Kurt W. Heisler, McDonough, NY (US)

(73) Assignee: Johnson Outdoors Inc., Racine, WI (US)

( * ) Notice: Subject to any disclaimer, the term of this patent is extended or adjusted under 35 U.S.C. 154(b) by 3 days.

(21) Appl. No.: 09/596,771

(22) Filed: Jun. 19, 2000

Related U.S. Application Data

(60) Provisional application No. 60/178,102, filed on Jan. 26, 2000.

(51) Int. Cl.[7] ..... E04H 15/54; E04H 15/64

(52) U.S. Cl. ..... 135/115; 135/117; 135/119

(58) Field of Search ..... 135/94, 95, 115, 135/117, 119

(56) References Cited

U.S. PATENT DOCUMENTS

| | | | | |
|---|---|---|---|---|
| 34,603 A | | 3/1862 | Townsend | |
| 39,416 A | | 8/1863 | Moakley | |
| 941,765 A | | 11/1909 | Davidson | |
| 1,522,644 A | | 1/1925 | Munson | |
| 1,531,473 A | | 3/1925 | Barbour | |
| 1,572,939 A | | 2/1926 | Leffert | |
| 1,575,902 A | * | 3/1926 | Dial | |
| 1,583,832 A | | 5/1926 | Hoigaard | |
| 1,666,961 A | * | 4/1928 | Delvin | |
| 1,704,945 A | | 3/1929 | Leffert | |
| 1,722,533 A | * | 7/1929 | McWane | |
| 2,133,118 A | | 4/1938 | Pyatt | 135/1 |
| 2,230,454 A | | 2/1941 | Friesner et al. | |
| 2,516,869 A | | 8/1950 | Harris | 135/1 |
| 2,666,441 A | | 1/1954 | Powers | |
| 2,742,912 A | | 4/1956 | Blanchard | 135/1 |
| 2,828,755 A | | 4/1958 | Stockman | 135/1 |
| 3,010,464 A | | 11/1961 | Moss | 135/5 |
| 3,174,493 A | | 3/1965 | Gruenberg | 135/5 |
| 3,182,672 A | | 5/1965 | Biller | 135/5 |
| 3,598,133 A | * | 8/1971 | Abert | |
| 3,621,857 A | * | 11/1971 | May et al. | |

(List continued on next page.)

FOREIGN PATENT DOCUMENTS

GB 2273723 A 6/1994

OTHER PUBLICATIONS

Johnson Worldwide Associates, Eureaka! "1997 Tents and Backpacks," bearing a designation "© 1996 Johnson Worldwide Associates".

PCT International Search Report for International Application No. PCT/US 01/1420, mailed Apr. 17, 2001.

*Primary Examiner*—Robert Canfield
(74) *Attorney, Agent, or Firm*—Foley & Lardner

(57) ABSTRACT

A tent with a retractable fly and a method for selectively adjusting the fly from inside the tent is disclosed. The tent includes a shell, a frame configured to support the shell, and a sheet adjustably coupled to the tent. The sheet may adjust between a substantially extended position and a substantially retracted position by a person inside of the tent. The method includes providing a cord having a first end attached to the fly and a second end disposed inside the tent, and actuating the position of the fly by adjusting the length of cord disposed inside the tent.

81 Claims, 12 Drawing Sheets

U.S. PATENT DOCUMENTS 3,670,747 A * 6/1972 Pohl et al.
3,716,211 A 2/1973 Butz ..... 248/168
3,759,277 A 9/1973 Glade ..... 135/4 R
3,875,952 A 4/1975 Black ..... 135/3 C
3,880,459 A 4/1975 Kelley
3,941,140 A 3/1976 Beavers ..... 135/4 R
3,943,952 A 3/1976 Marquart et al. ..... 135/1 R
3,965,915 A * 6/1976 Kirkham
4,067,346 A 1/1978 Husted ..... 135/4 R
4,068,674 A * 1/1978 Mithcell
4,077,417 A 3/1978 Beavers ..... 135/3 R
4,102,352 A * 7/1978 Kirkham
4,236,543 A 12/1980 Moss ..... 135/3 R
4,269,210 A 5/1981 Marks ..... 135/1 R
4,332,266 A 6/1982 Wageley ..... 135/5 R
4,576,116 A 3/1986 Binkert ..... 119/19
4,646,770 A 3/1987 Lobato ..... 135/102
4,709,718 A 12/1987 Nichols ..... 135/106
4,716,918 A 1/1988 Hayashida et al. ..... 135/93
4,751,936 A 6/1988 Zibble et al. ..... 135/117
4,757,832 A 7/1988 Russell ..... 135/104
4,858,635 A 8/1989 Eppenbach ..... 135/104
4,941,499 A 7/1990 Pelsue et al. ..... 135/104
4,966,178 A 10/1990 Eichhorn ..... 135/104
5,067,505 A 11/1991 Cantwell et al. ..... 135/104
5,069,572 A 12/1991 Niksic ..... 403/170
5,199,375 A 4/1993 Johson ..... 116/209
5,343,887 A 9/1994 Danaher ..... 135/104
5,421,355 A 6/1995 Cantwell ..... 135/120.3
5,458,146 A 10/1995 Gregg ..... 135/91
5,467,794 A 11/1995 Zheng ..... 135/125
5,634,483 A 6/1997 Gwin ..... 135/131
5,638,850 A 6/1997 Hazinski et al. ..... 135/120.1
5,641,192 A * 6/1997 Smith et al.
5,771,912 A 6/1998 Swetish ..... 135/87
5,806,547 A * 9/1998 Derlinga
5,915,400 A 6/1999 Pohl et al. ..... 135/125
6,021,796 A * 2/2000 Vavra
6,109,281 A * 8/2000 Lowenthal

* cited by examiner

FIG. 3
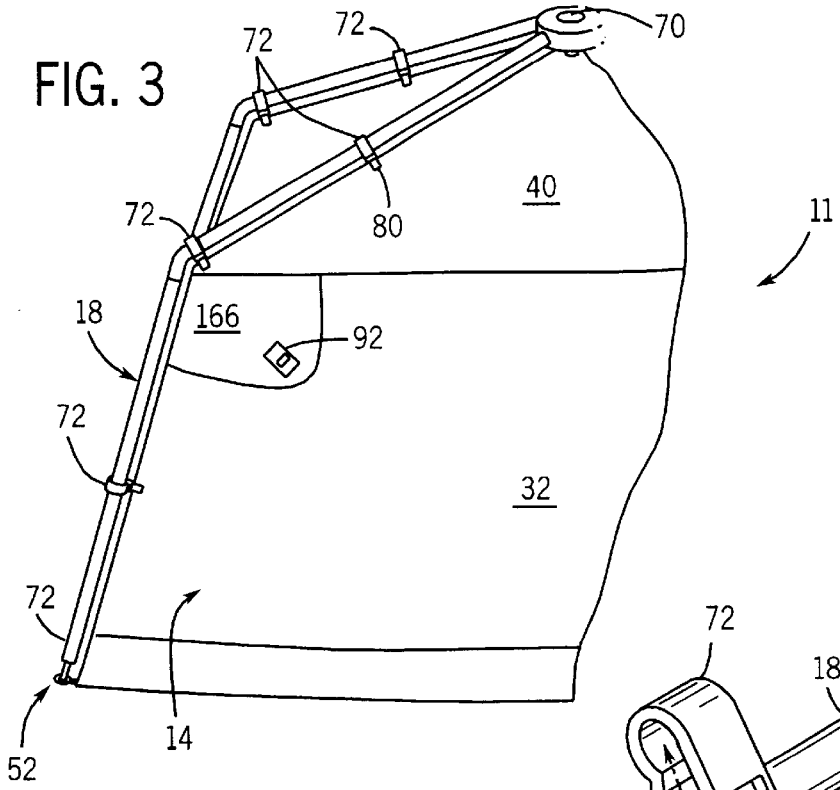
FIG. 6
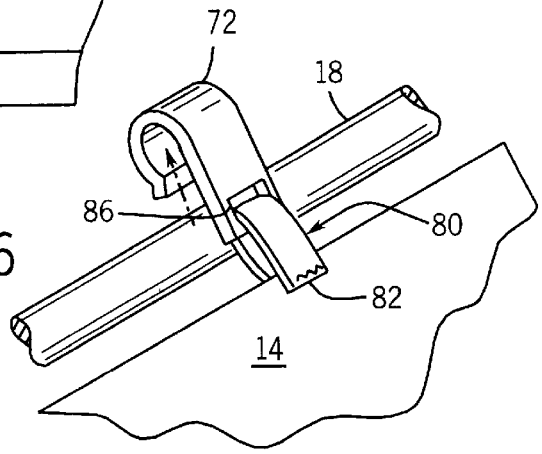
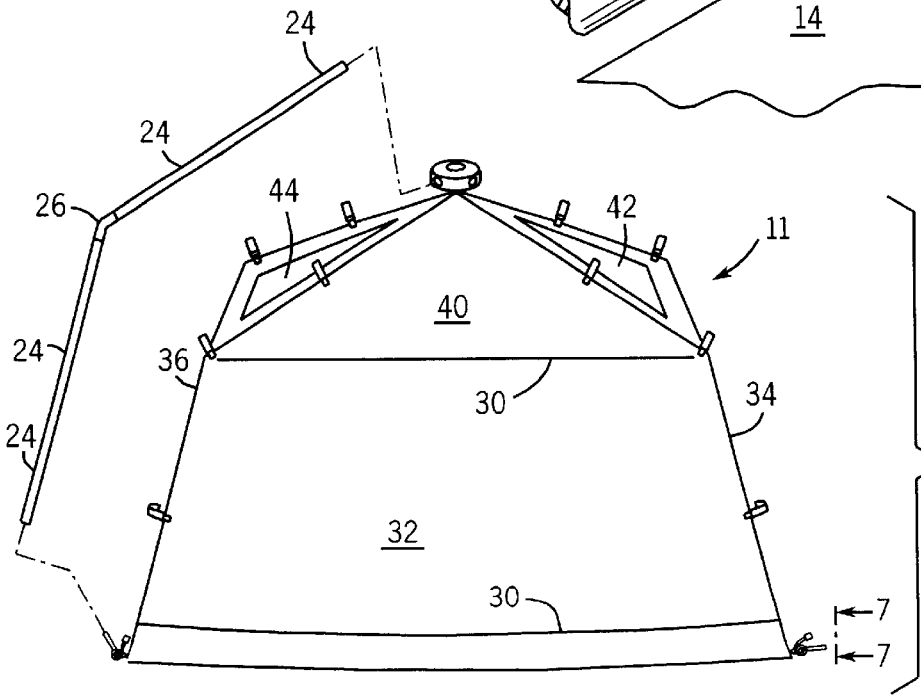
FIG. 4

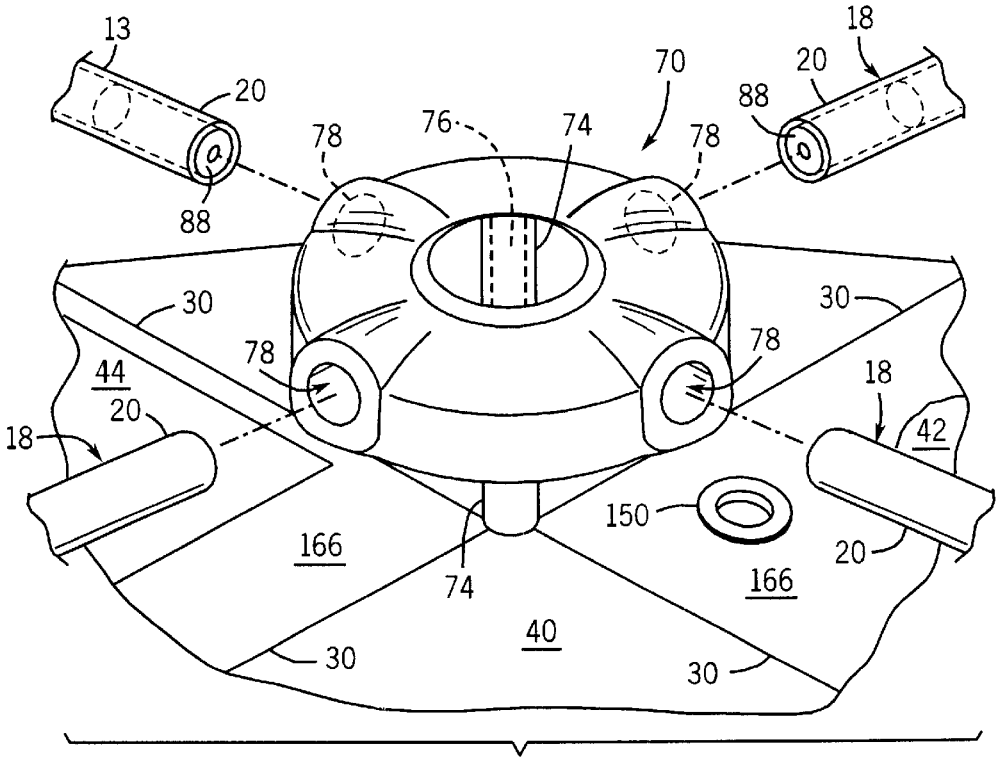
FIG. 5
FIG. 8
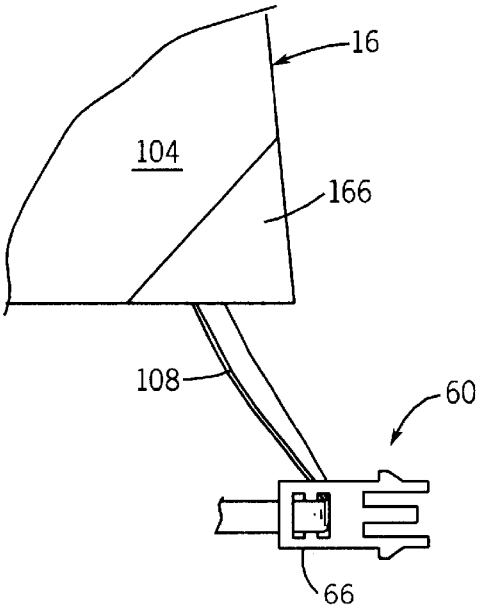
FIG. 7
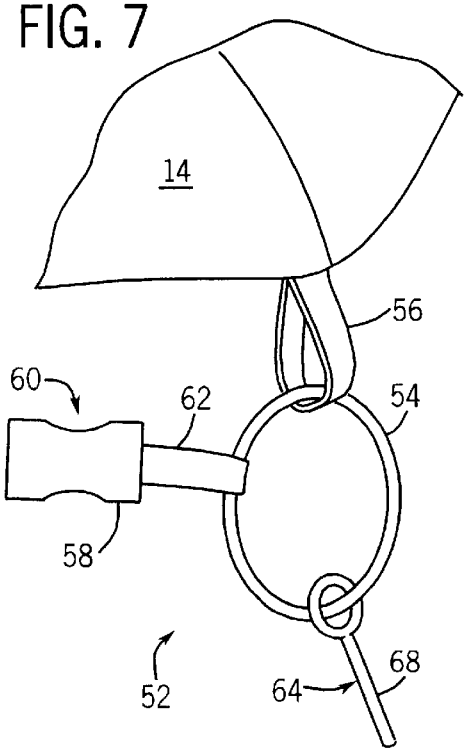

TENT WITH RETRACTABLE FLY

CROSS-REFERENCE TO RELATED APPLICATION

This application claims the benefit of priority from U.S. Provisional Application having Ser. No. 60/178,102, filed Jan. 26, 2000 and entitled "Tent With Retractable Fly," which Provisional Application is hereby incorporated by reference.

FIELD OF THE INVENTION

The present invention relates to canopy structures such as a tent and various other shelters. In particular, the present invention relates to the tent having a retractable fly.

BACKGROUND OF THE INVENTION

Tents and various other shelters come in a variety of sizes, shapes and configurations and are used to provide portable, temporary shelter during activities such as camping or other recreational activities. Typically, tents include a fabric shell and a framework of elongate poles to support the shell.

Shelter against precipitation is typically provided by water repellent or water-resistant material that forms the shell. However, during the appropriate weather conditions, water repellent or water-resistant material may cause condensation to collect on the inside of the tent. Such condensation causes discomfort to the occupants, dampness to clothing and gear, and a potential for growth of mildew.

In an attempt to overcome the shortcomings of such material, the use of "breathable" material, or vents made of screen or mesh may be employed. However, such configurations have limited water repellant characteristics and are difficult to seal.

It is well known to attach a protective, water-repellant or water-resistant covering (commonly known as a "fly") to a tent to offer additional protection from outdoor elements (e.g., rain, snow, bugs, etc.) and ventilation to its occupants. In a general sense, such known applications provide protection from outdoor elements and ventilation. When flies are employed, the shell may include venting without having to provide water repellant seals.

Although such flies are commonly used, such flies have several distinct drawbacks. Such known configurations are typically characterized either by their lack of adjustability or inconvenience. As a result, such known applications are generally not well suited for situations where egress of tent to make positional adjustments to the fly is not desirable or is inconvenient. First, for example, a camper must exit the tent when he or she wishes to adjust the fly—a significant drawback when it is raining, when there are a lot of insects, etc. Second, known ways of adjusting flies comprise inefficient steps. Several known flies require several repetitive steps to adjust a fly to a desired position. Third, even when adjustable, the flies of such tents are not used as intended because of their inconvenience and therefore the benefits of such "adjustability" are not realized by the user.

Thus, there is a continuing need for a tent having a fly that is moveable between a substantially extended position and a substantially retracted position, that provides a water repellant or water resistant protection from the elements, that allows for the interior of the tent to be ventilated, that provides the occupants with a "skylight" or window to enjoy the outdoors, that allows and encourages use and engagement of such vents and skylights, and that has an actuation interface which is operable from inside the tent in a manner that facilitates use and enjoyment.

Accordingly, it would be advantageous to have a tent with a fly adapted to be substantially extended or retracted (i.e. closed or opened) without the user having to exit the tent. It would also be advantageous to have a tent with fly that includes a portal that allows for ventilation and/or viewing that may be uncovered by adjustment of the retractable fly. It would further be advantageous to have a retractable fly that requires a minimum amount of assembly.

SUMMARY OF THE INVENTION

The present invention relates to a tent system. The tent includes a tent having a shell and a frame configured to support the shell. The tent system also includes a sheet adjustably coupled to the tent. The sheet may adjust between a substantially extended position and a substantially retracted position by a person inside of the tent.

The present invention also relates to a tent system. The tent system includes a tent including a shell and a frame adjacent the shell. The tent system also includes a sheet coupled to the shell, and means for adjusting the sheet between a substantially extended position to a substantially retracted position.

The present invention further relates to a method for selectively adjusting a fly from inside a tent relative to an underlying shell. The method includes providing a cord having a first end attached to the fly and a second end disposed inside the tent, and actuating the position of the fly by adjusting the length of cord disposed inside the tent.

The present invention further relates to a covering for a tent having a shell and a frame configured to support the shell. The covering includes a sheet adjustably coupled to the tent. The sheet may adjust between a substantially extended position and a substantially retracted position by a person inside of the tent.

The present invention further relates to various features and combinations of features shown and described in the disclosed embodiments.

BRIEF DESCRIPTION OF THE DRAWINGS

FIG. 3 is a fragmentary elevation view of the tent of FIG. 1 without an attached fly.

FIG. 4 is an exploded elevation view of the tent of FIG. 3.

FIG. 5 is an exploded fragmentary elevation view of the tent of FIG. 4.

FIG. 6 is an exploded fragmentary elevation view of the tent of FIG. 4.

FIG. 7 is a fragmentary elevation view of the tent of FIG. 4 taken along line 7—7.

FIG. 8 is a fragmentary elevation view of a corner of fly of FIG. 1.

DETAILED DESCRIPTION OF THE PREFERRED EMBODIMENTS

Figure 1:
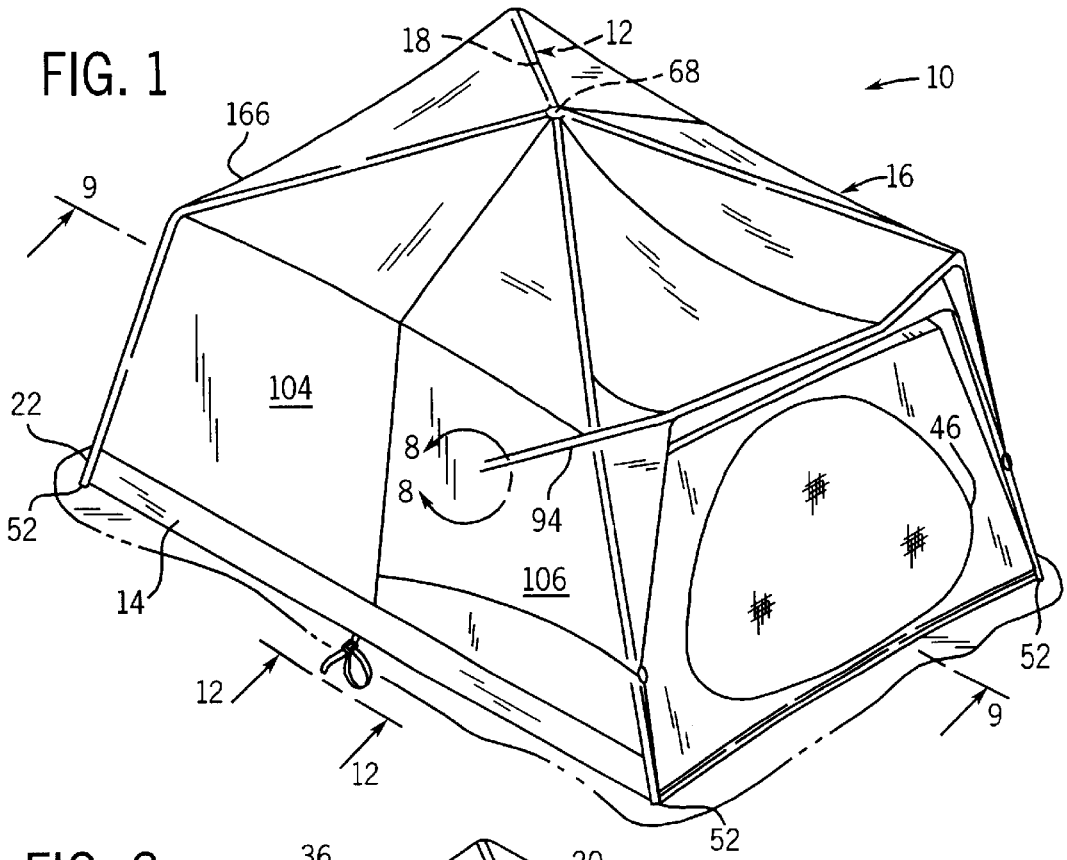
FIGS. 1 and 2 are perspective views of a tent and a fly according to an exemplary embodiment of the present invention.
Figure 2:
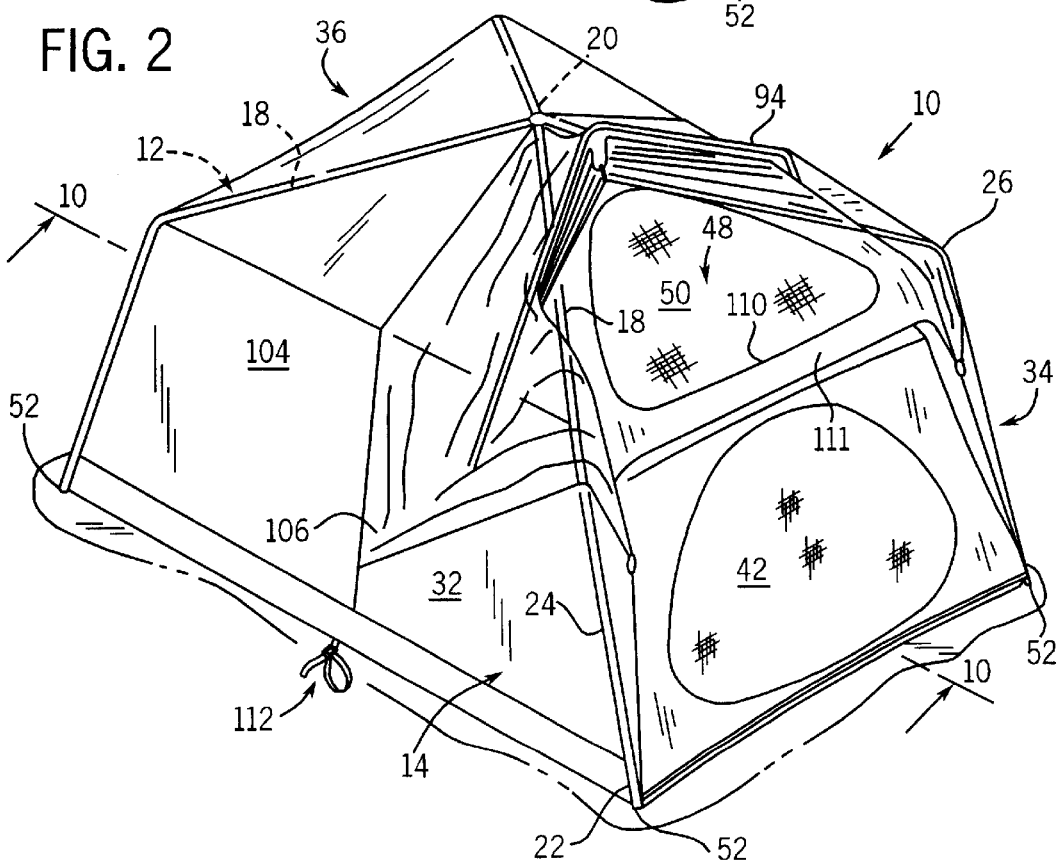

FIGS. 1–3 illustrate a tent system 10 including a tent 11 having a frame 12 supporting a shell 14. Tent system 10 also includes a overlaying covering or sheet (shown as a fly 16) configured to be selectively adjusted by an occupant "inside" of shell 14. "Inside" of shell 14 is intended to mean that the occupant substantially inside of the shell 14 and encompass alternative embodiments wherein the occupant extends a portion of his or her body (e.g., hand, arm, etc.) outside of the shell to selectively adjust fly 16). Selective adjustment of fly 16 may take many of a variety of forms, including pivoting, sliding, rolling, "bunching," stretching, etc.

Frame 12 includes a plurality of segmented poles 108 each including an end 20 and an end 22. According to a preferred embodiment, each frame pole 18 is formed from four substantially straight sections 24 and a bent section 26, and is made from a rigid material (e.g., aluminum, plastic, etc.) and connected by an elastic or "bungy" cord attached to the outer sections. According to an alternative embodiment, frame poles 18 may be comprised of a plurality of substantially straight sections and an elbow configured to provide a bend in pole 18. According to alternative embodiments, poles 18 may have various shapes depending upon the desired shape and size of the tent and may be made from a variety of materials (e.g., plastic, metal bands, etc.) designed to provide the desired characteristics.

Figure 9:
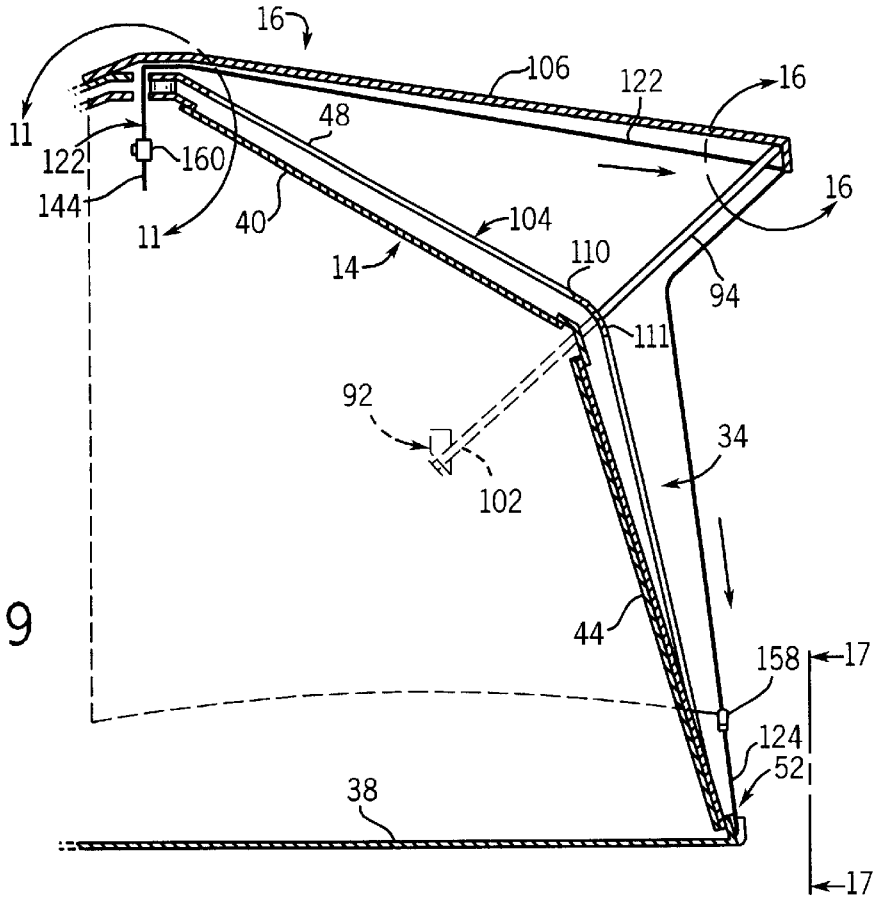
FIG. 9 is a fragmentary sectional view of the tent of FIG. 1 taken along line 9—9.

As shown in FIGS. 4 and 9, shell 14 defines a space for users to occupy and store gear. Shell 14 is formed by a plurality of flexible fabric panels or sheets connected by seams 30 which together comprise walls 32, ends 34, 36, a floor 38, and a roof 40.

Ends 34, 36 of shell 14 preferably include multiple layers of material for selective arrangement for privacy, ventilation, etc. According to a preferred embodiment, ends 34, 36 include a vent 42 and/or an imperforate sheet 44. Either or both of vent 42 and imperforate sheet 44 may be provided with a closure mechanism 46 (e.g., a zipper, latch-hook fastener, etc.) which may be selectively opened from inside and/or outside tent 11. When end 34 and/or end 36 are configured to provide the user with ingress to and egress from the space defined by shell 14, both vent 42 and imperforate sheet 44 include closure mechanism 46. According to an alternative embodiment, imperforate sheet 44 is made from material that has any of a variety of degrees of light transmission (e.g., between opaque and transparent).

According to a preferred embodiment, except for sheets or panels that provide ventilation functions, walls 32, floor 38, and ends 34 and 36 are made from water repellant or water resistant material. According to an alternative embodiment, portions of roof 40, walls 32, floor 38, or ends 34 and 36 may be formed from "breathable" material (i.e., material having a lesser degree of water resistance).

As shown in FIGS. 2–4, shell 14 further includes one or more roof portals 48 to provide a variety of functions (e.g. ventilate air, to provide a "window" or "skylight," etc.). Portals 48 are located in roof 40 adjacent end 34 and/or end 36. According to a preferred embodiment, portal 48 includes a vent 50 formed by netting or screen made from nylon. According to an alternative embodiment, portals 48 are made of imperforate material with any of a variety of degrees of light transmission (i.e., between opaque and transparent).

Referring to FIG. 7, shell 14 also includes four corner assemblies 52 configured to interface with frame 12 and fly 16. Each corner assembly 52 includes a ring 54 attached to shell 14 by a strap 56 formed into a loop, a female portion 58 of a snap connector 60, preferably a side release buckle, attached to ring 54 by a strap 62, and a key 64 also attached to ring 54. Female portion 58 of snap connector 60 is configured to couple with a male portion 66 of snap connector 60 (shown in FIG. 8), which is attached to fly 16 by a strap 108. Key 64 includes a post 68 configured to be inserted into end 20 of poles 18.

Referring to FIGS. 3–6, shell 14 is coupled to frame by a hub 70 and a plurality of hooks or clips 72. Hub 70 includes a member 76 and is coupled to frame 12 by a strap 74 looped around member 76 and attached (e.g., sewn or stitched) to shell 14, and includes a plurality of receptacles 78 configured to receive poles 18 of frame 12. According to a preferred embodiment, hub 70 is made of plastic (e.g., thermoplastic, thermoset, etc.). Poles 18 are bent or flexed so that one end 20 couples with hub 70 and the other end 22 receives post 68 of key 64. As such, floor 38 of shell 14 is expanded or stretched and clips 72 are attached to poles 18 to form a free-standing structure resistant to collapse or dislodgment. End 20 of pole 18 is configured to receive key 64 of corner assembly 52 of shell 14, and the other end is configured to not receive key 64 so that pole 18 is orientated in the designed manner. For example, end 22 of pole 18 may include an insert 88 so that key 64 will not fill in end 22 of pole 18 and to provide additional support for the portion of pole 18 that is inserted into hub 70.

As shown in FIGS. 3, 4, and 6, clips 72 are attached to shell by straps 80 which extend from the interface of ends 34 and 36 and walls 32 or roof 40. Ends 82 of each strap 80 are coupled (e.g., sewn or stitched) to shell 14 to form a loop 84 which passes though an aperture 86 on clip 72 to secure clip 72 to shell 14. Clip 72 is generally "J-shaped" and provides an interference or "snap" fit engagement between shell 14 and frame pole 18. According to a preferred embodiment, clip 72 is made from a semi-flexible material (e.g., plastic commercially available as a product designated "DELRIN" from E. I. du Pont de Nemours and Company of Wilmington, Del., or other materials having similar properties) that flexes as clip 72 is being attached to pole 18 and returns to its original shape.

Referring to FIGS. 1, 2, 9 and 11, fly 16 is configured to overlay at least a portion of shell 14 and have adjustable movement (e.g., pivoting between a substantially extended position and a substantially retracted position, or the like) for selectively exposing portions of shell 14 and/or tent 11. Fly 16 is made of a plurality of sheets or panels that are configured to provide water repellant or water resistant protection to shell 14 and its contents and occupants. Fly 16 includes a main sheet 104 and a retractable sheet 106 operably coupled to main sheet 104.

Main sheet 104 is configured to cover substantially the entire shell 14 except ends 34 and 36 and portal 48. The arrangement is configured to provide increased insulation without decreasing ventilation by providing a space formed between main sheet 104 and shell 14. This space between fly 16 and shell 14 is provided by the arrangement of shell 14, frame 12 with hub 70, and fly 16.

Main sheet 104 of fly 16 includes an aperture 110 that is approximately the size and shape of portal 48 of shell 14 and is configured to open portal 48 to the outside environment for ventilation viewing the outdoors, lighting the interior of tent 11, etc. A strip 111 of material spans the end of main sheet 104 to provide additional structural strength to main sheet 104.

Figure 12:
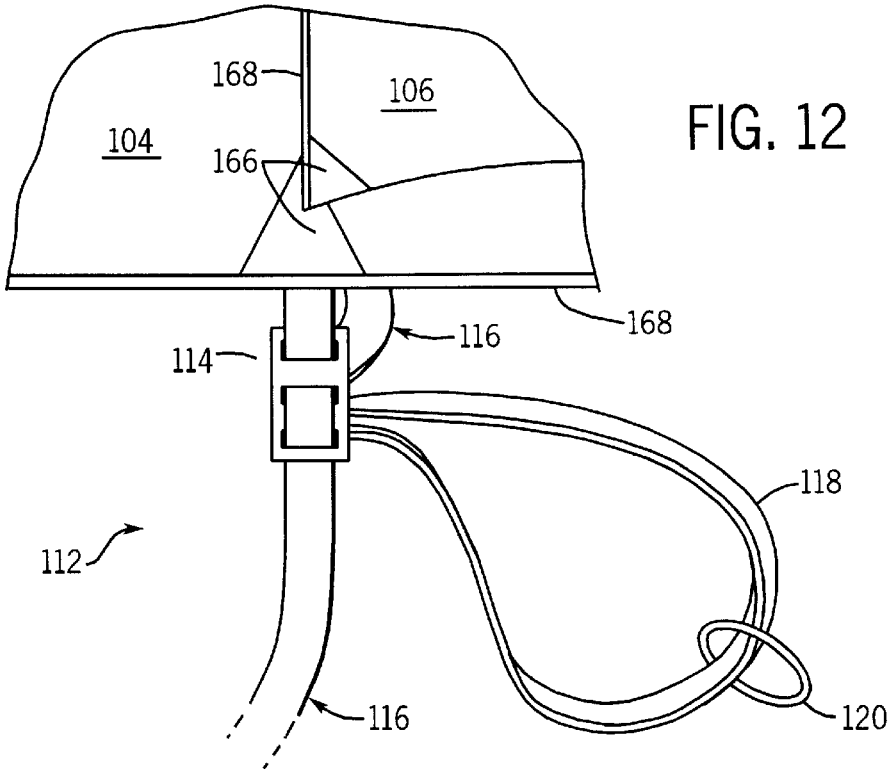
FIG. 12 is a fragmentary elevation view of the tent of FIG. 1 taken along line 12—12.

Referring to FIG. 12, main sheet 104 also includes side strap assemblies 112 configured to provide a variety of functions (e.g., staking tent 110 to structure or the ground, attaching equipment, etc.). One end of side strap assemblies 112 is attached to main sheet 104 of fly 16. Side strap assemblies 112 each include a buckle 114 attached to main sheet 104 of fly 16 and a strap 116 threaded through buckle 114. This coupling of strap 116 and buckle 114 is configured to provide for a non-slip threading arrangement. As such, a loop 118 may be formed that has variable dimensional characteristics. A ring 120 may be coupled to loop 118 of strap 116 and is configured to provide an interface for the desired engagement. For example, a stake (not shown) can be inserted through ring 120 and pushed or pounded into the ground, ring may be coupled to adjacent structure (e.g., tied to a tree with a rope), or ring 120 may be used to attach equipment for organization and loss prevention purposes, etc.

Figure 10:
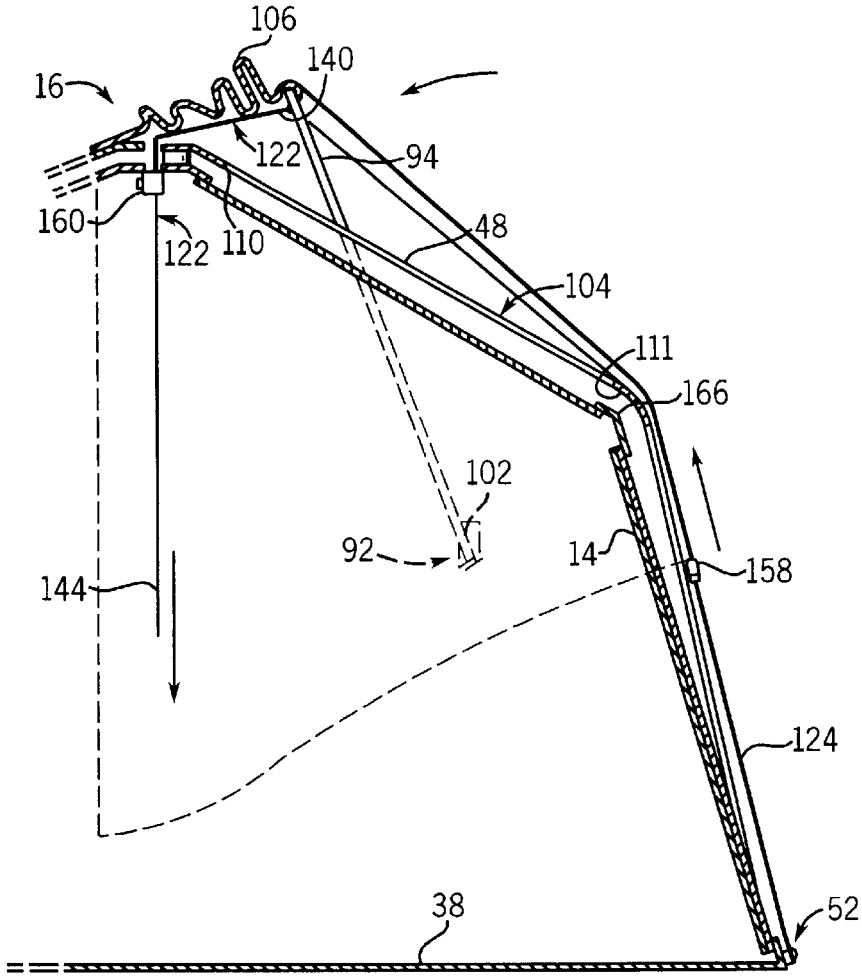
FIG. 10 is a fragmentary sectional view of the tent of FIG. 2 taken along line 10—10.
Figure 11:
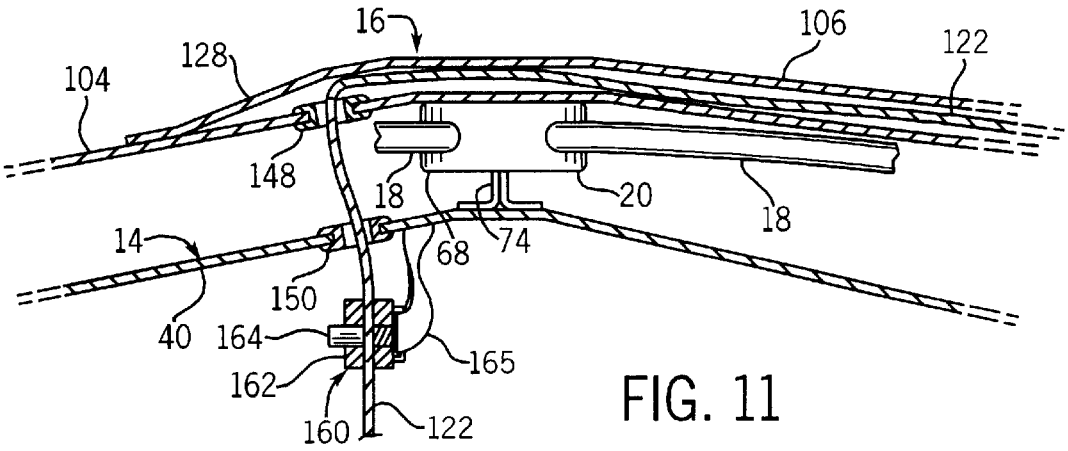
FIG. 11 is a fragmentary sectional view of the tent of FIG. 9 taken along line 11—11.

As shown in FIGS. 11 and 12, retractable sheet 106 of fly 16 is attached to main sheet 104 by any of a variety of methods and arrangements. According to a preferred embodiment, one end 128 of retractable sheet 106 is sewn or stitched to main sheet 104 working with an adhesive (which is intended to provide additional strength and water resistant properties). Alternatively, main sheet 104 and retractable sheet 106 are integrally formed. Retractable sheet 106 may be attached to main sheet 104 at a variety of locations according to the desired configurations of fly and/or tent 11. As shown in FIGS. 1, 2, and 9–12, retractable sheet 106 is attached to main sheet 104 at approximately the midpoint of main sheet 104.

Referring to FIGS. 7, 8, 13, and 14, fly 16 is coupled to shell 14 by snap connectors 60, by engagement between an actuation mechanism (shown as a pair of pivot mechanisms 92) and a fly pole 94, and by an elastic cord 124. As shown in FIG. 8, male snap connectors 66 are attached to the corners of main sheet 104 with straps 108 and are configured to couple to female portion 58 of snap connectors 60 of corner assemblies 52 attached to shell 14.

Figure 13:
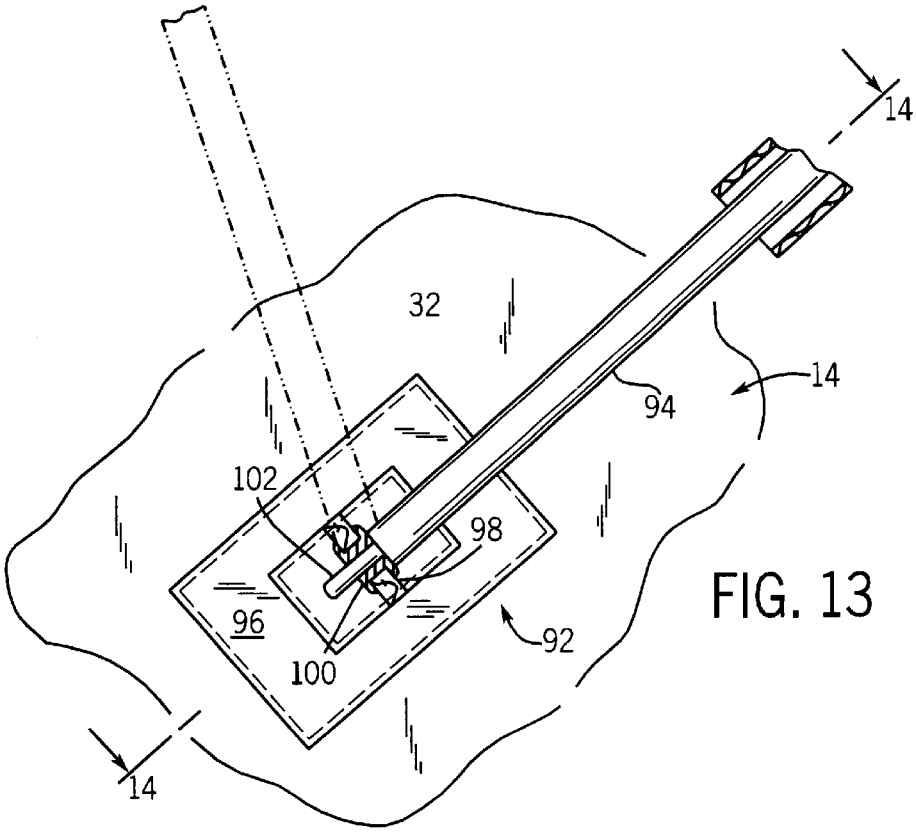
FIG. 13 is a side elevation view of a pivot mechanism of FIG. 3.
Figure 14:
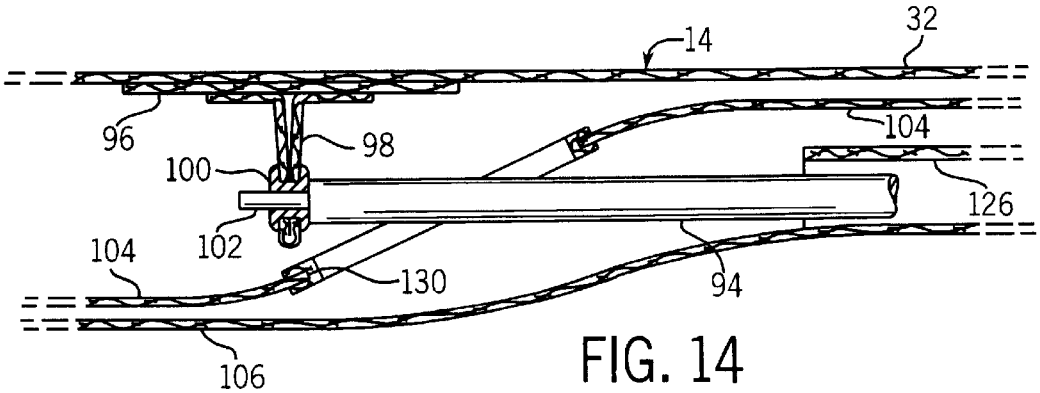
FIG. 14 is a fragmentary sectional view of the pivot mechanism of FIG. 13 taken along line 14—14.

Pivoting of fly is provided by cooperation among pivot mechanisms 92, fly pole 94, an actuation interface (shown as a pull cord 122), and a biasing member (shown as a elastic cord 124). As shown in FIGS. 13 and 14, each pivot mechanism 92 includes a base 96 attached to shell 14 (e.g., sewn or stitched), and provides a reinforcing structure for a pivot member 98. Pivot member 98 extends from base 96 and includes an eyelet or grommet 100. Grommet 100 is configured to receive end 102 of fly pole 94. According to a preferred embodiment, pivot member 98 is a single length of material (e.g., any of a variety of flexible material such as nylon, polyester, etc.) that is attached (e.g., sewn or stitched working with an adhesive) at its ends to base 96 such that its middle section may be folded onto itself and held together by grommet 100. In operation, ends 102 of fly pole 94 are inserted into grommets 100 on opposite walls 32 of shell 14 such that when fly 16 is retracted or extended, pivot member 98 twists to allow the desired amount of movement of fly pole 94. According to a particularly preferred embodiment, pivot mechanism 92 is attached to shell 14 at an approximately 45° angle and grommet 100 is also at an approximately 45° angle.

A sleeve 126 is disposed along an end 128 of retractable sheet 106 and is configured to receive fly pole 94. Ends 102 of fly pole 94 have a reduced diameter and are configured to fit in grommets 100 of pivot mechanism 92. As such, fly pole 94 of retractable sheet 106 is adapted to pivot about pivot mechanism 92 by twisting of pivot member 98. Pivot mechanisms 92 are accessed by ends 102 of fly pole 94 through a pair of apertures 130 in main sheet 104 of fly 16.

Figure 15:
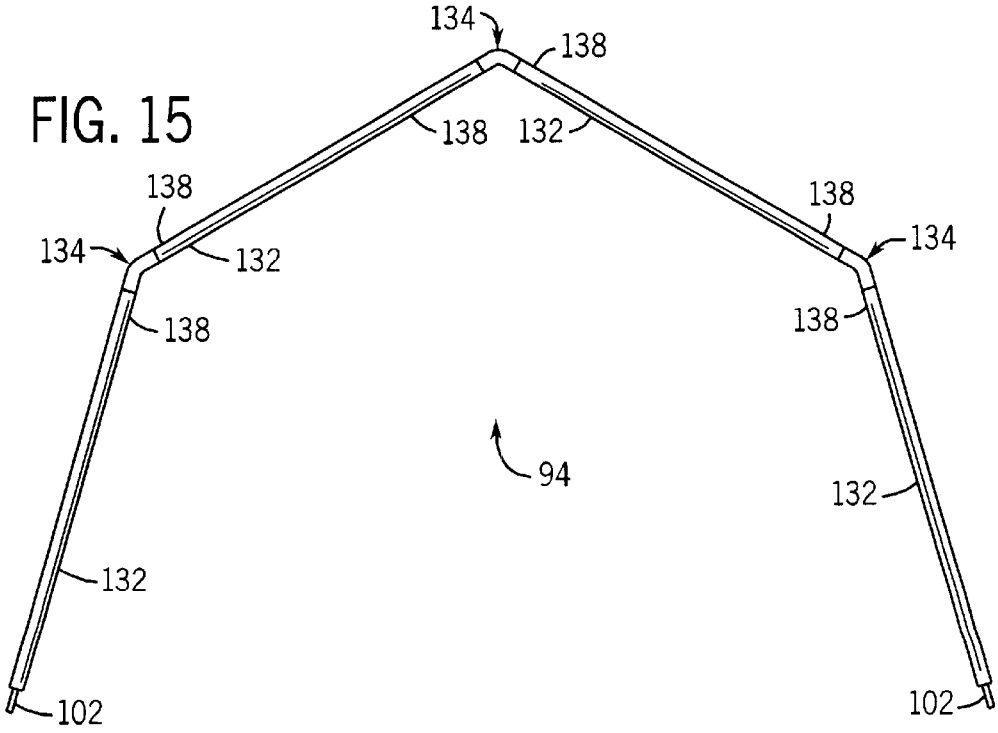
FIG. 15 is front elevation view of a fly pole of the fly of FIG. 1.
Figure 16:
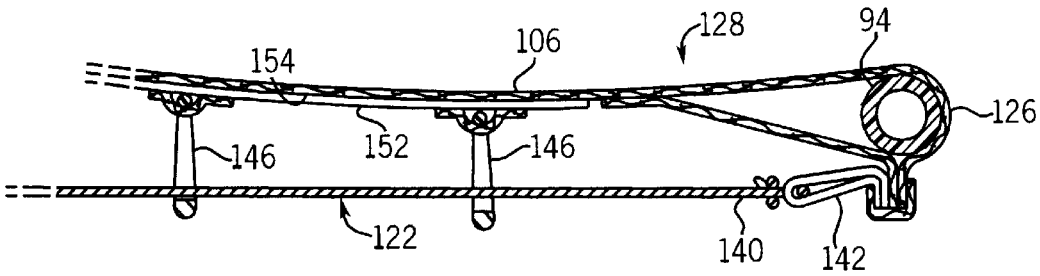
FIG. 16 is a fragmentary sectional view of the tent of FIG. 9 taken along line 16—16.

According to a preferred embodiment shown in FIG. 15, fly pole 94 includes four substantially straight tubes or sections 132, connected by a "bungy" cord attached to ends 102 of the outer sections. An elbow 134 is located between each section 132 and is configured to provide a "predetermined bend" between the segments of fly pole 94. Ends 136 of elbow 134 are sized to fit into ends 138 of straight sections 132. The "predetermined bend" is determined by the shape and relative dimensions of shell 14 (e.g., walls 32 and roof 40) so that fly 16 may be retracted with a minimum of interference between fly pole 94, shell 14 and poles 18 of frame 12. According to an alternative embodiment, fly pole 94 may be formed by a single member or tube, or a plurality of bent tubes or sections. According to any embodiment, fly pole 94 may be configured to be used on any style of tent (e.g., dome, umbrella, A-frame, etc.).

Referring to FIGS. 9–11 and 16, pull cord 122 is attached at one end 140 to fly 16 by a strap 142 stitched to retractable sheet 106. The other end 144 is threaded through a plurality of clips 146 (preferably three) and is disposed across shell 14, over hub 70, and through a grommet 148 in main sheet 104 and a grommet 150 in roof 40 of shell 14. According to a preferred embodiment shown in FIG. 11, grommets 148, 150 are located immediately adjacent hub 70 so that force imparted by pull cord 122 when retracting fly 16 is distributed through frame 102.

Clips 146 are coupled to a strap 152 that is attached to an inside surface 154 of retractable sheet 106. Clips 146 are configured to keep pull cord 122 from obstructing the user as he or she enters or exits tent 11, and to provide a bearing surface to assist fly 16 when being pivoted. End 144 freely hangs within space defined by shell 14 and provides an operative interface between the occupant within tent 11 and fly 16. According to an alternative embodiment, pull cord 122 is attached to an inside surface or structure of shell (e.g., hook, latch-hook fastener, etc.).

Figure 17:
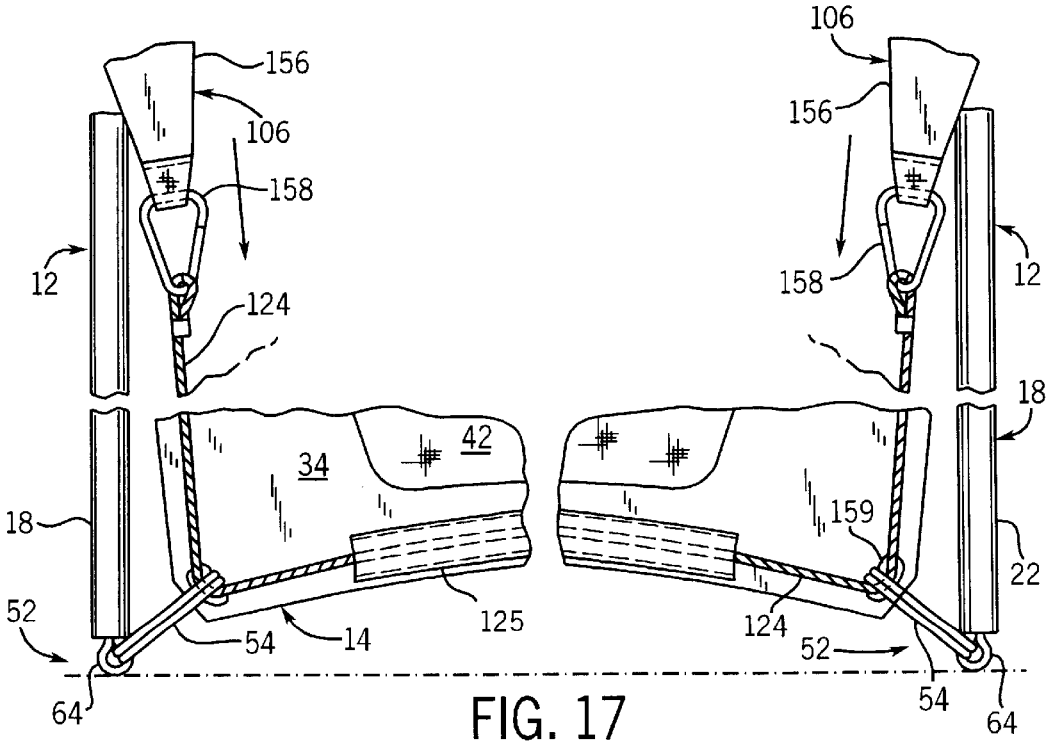
FIG. 17 is a fragmentary elevation view of the tent of FIG. 9 taken along line 17—17.

Referring to FIG. 17, elastic cord 124 is coupled to shell 14 by sleeve 125, and is threaded through rings 54 of corner assemblies 52 and coupled to corners 156 of retractable sheet 106 by a pair of clips 158. When connected, elastic cord 124 biases retractable sheet 106 in an extended position (as shown in FIG. 1) in the direction generally indicated by the arrow. As such, pulling of pull cord 122 stretches elastic cord 124 as retractable sheet 106 is pivoted toward the open or retracted position (as shown in FIG. 2). According to a preferred embodiment shown in FIG. 17, a bearing 159 is disposed between cord 124 and ring 54 to reduce friction. According to a particularly preferred embodiment, bearing 159 is a plastic D-ring.

As shown in FIGS. 9 and 10, to retract fly 16, the occupant pulls pull cord 122 in a generally downward direction until fly 16 is sufficiently retracted. Tension in pull cord 122 causes fly pole 94 to pivot toward hub 70 thereby stretching elastic cord 124. When fly 16 is in a desired position, a locking device 160 slidably coupled to pull cord 122 may be used to fix fly 16 in a static position. As shown in FIG. 11, locking device 160 includes a barrel 162, a sliding member 164, and a spring (not shown). Pull cord 122 is threaded through barrel 162 and sliding member 164 is biased against pull cord 122 by the spring to prevent locking device 160 from sliding relative to pull cord 122.

According to a preferred embodiment shown in FIG. 11, locking device 160 is attached to roof 40 of shell 14 with a strap 165 so that fly 16 may be operated (retracted or extended) with one hand. To retract fly 16, the user pulls pull cord 122 downward; strap 165 secures locking device 160 in the same general position so that pull cord 122 may slide through barrel 162. To extend fly, the user depresses sliding member 164 to allow pull cord 122 to slide through barrel 162 until the desired amount of fly 16 extension is reached.

According to a preferred embodiment, shell 14, retractable sheet 106, and main sheet 104 include reinforced sections 166 configured to provide additional strength to the tent and to resist wear due to use and operation. Reinforced sections 166 may be formed by any of a variety of arrangements and placed at various locations. According to a preferred embodiment, reinforced sections are formed by material having wear resistant properties. According to an alternative embodiment, reinforced section is formed by material having a greater thickness or by double layers of material that are sewn or stitched together. According to a preferred embodiment, edges of the sheets or panels have cuffs 168 formed by folded-over material and configured to provide resistance against wear and fraying. Reinforced sections 166 and cuff 168 are intended to increase the strength and durability of tent system 10.

Figure 18:
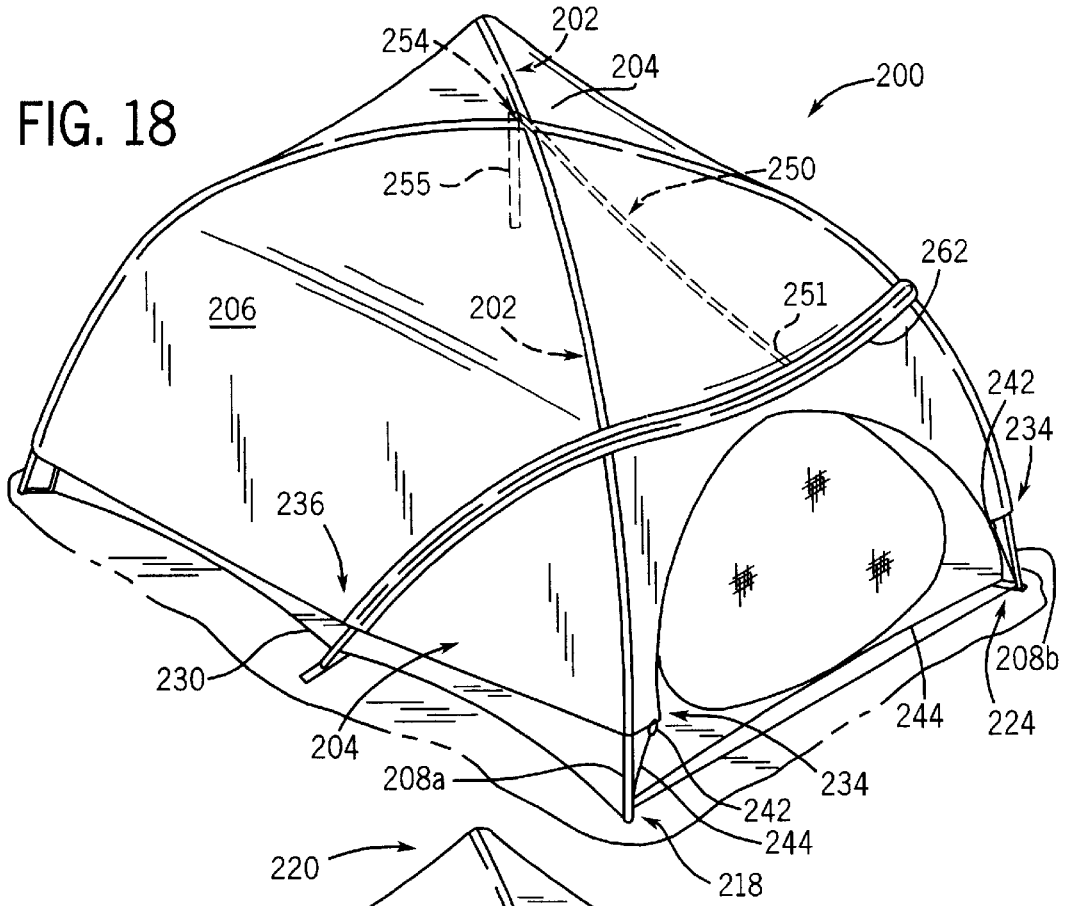
FIGS. 18 and 19 are perspective views of an alternative embodiment of the tent of FIG. 1.
Figure 19:
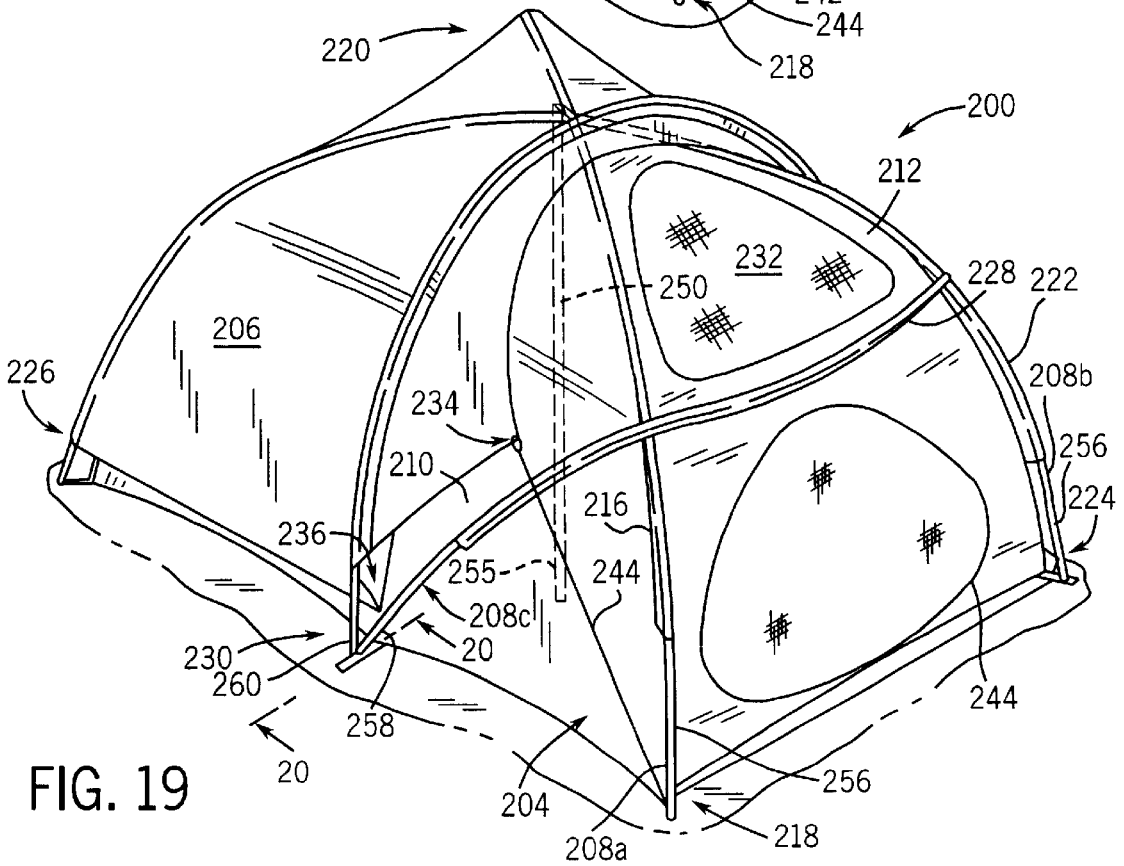
Figure 20:
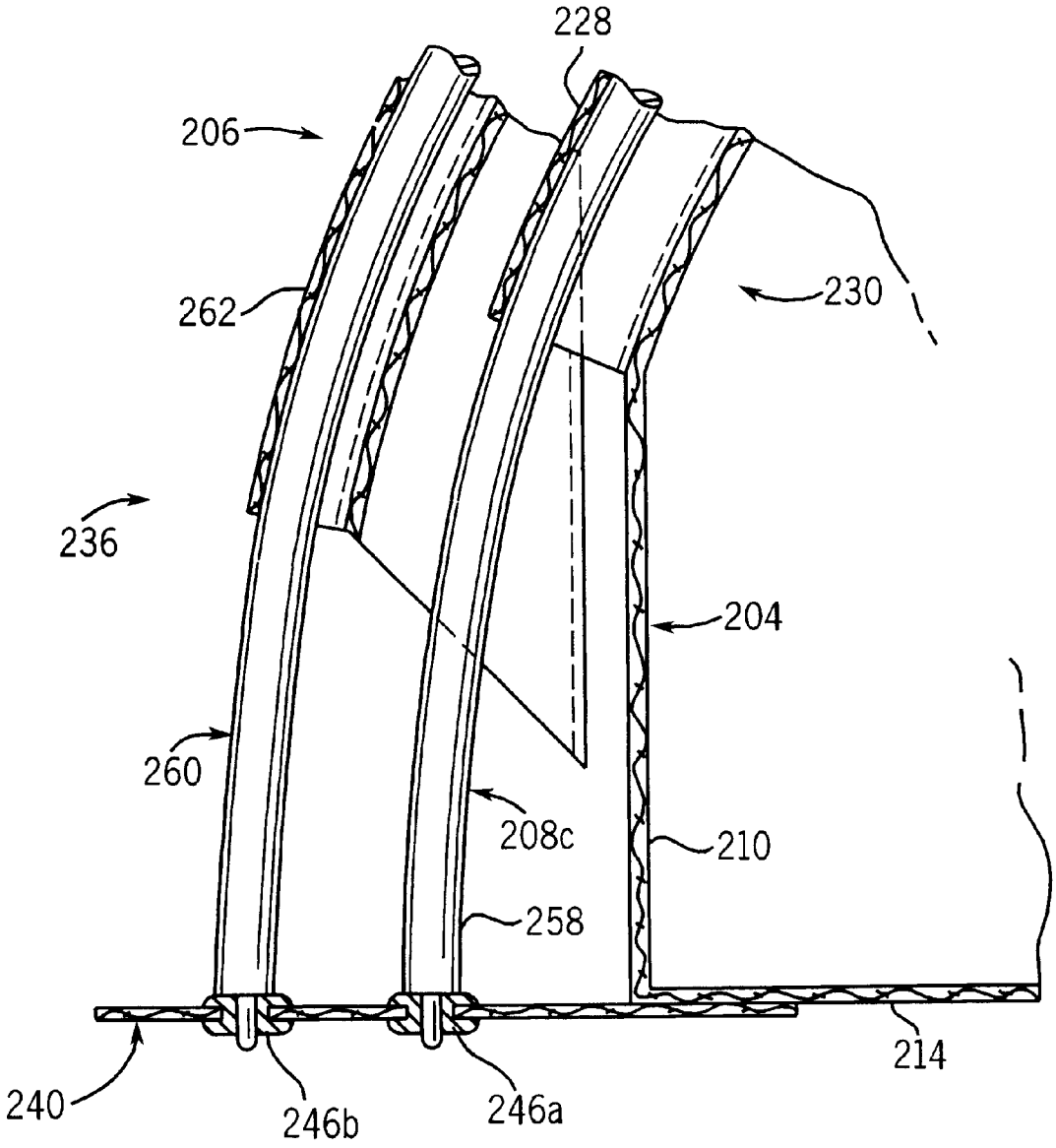
FIG. 20 is a fragmentary sectional view of the tent of FIG. 19 taken along line 20—20.

FIGS. 18–20 illustrate a tent 200, an alternative embodiment of tent system 10 shown in FIGS. 1–17. Tent 200 includes a frame 202, a shell 204, and a retractable fly 206. Frame 202 includes a plurality of poles 208*a*, 208*b*, and 208*c* configured to support shell 204.

Shell 204 includes walls 210, a roof 212, and a floor 214, which define a space configured for storage or occupancy. Shell 204 also includes a sleeve 216 spanning from approximately a corner 2108 across shell 204 to an opposite corner 220; a sleeve 222 spanning from approximately another corner 224 across shell 204 and over sleeve 216 to corner 226; and a sleeve 228 spanning mid-points 230 of shell 204. Sleeves 216, 222, and 228 are configured to removably receive elongate poles 208*a*, 208*b*, 208*c*, which are inserted through the sleeves and arcuately bent to place sleeves 218, 222, 228 and shell 204 in tension to support shell 204. According to a preferred embodiment, sleeves 216, 222, 228 are made from nylon webbing that is sewn or stitched to shell 204. Poles 208*a*, 208*b*, 208*c* are made of a plurality of interconnected segments and may be separated and folded for storage, transport, etc. A plurality of straps 240 are attached to shell 204 at corners 218, 220, 224, 226, and mid-points 230 and include a grommet 246*a* and a grommet 246*b*. Grommets 246*b* of straps 240 at corners 218, 220, 224, 226 receive ends 256 of poles 208*a*, 208*b*. Grommets 246*a* of straps 240 at mid-points 230 receive ends 258 of pole 208*c*. Grommets 246*b* of strap 240 at mid-points 230 receive ends of fly pole 260.

Shell 204 further includes one or more vents 232 configured to provide a vent and/or a window for comfort and enjoyment of the occupants of tent 200. Vents 232 are preferably made from a nylon mesh or screen configured to allow the flow of air but to keep out insects.

Fly 206 substantially covers shell 204 and is configured to provide protection to shell 204 and to prevent rain from entering the inside of tent 200 through vents 232. Fly 206 is coupled to shell 204 by connector clips 242, an elastic cord 244, and a fly pole 260. Clips 242 include a male end attached to shell 204 and a female end attached to fly 206.

Elastic cord 244 passes through grommets 246*a* on straps 240 at corners 2108, 224, and includes clips 248 that couple to fly 206 (e.g., to a ring attached to fly 206, a loop formed by a strap attached to fly 206, etc.) adjacent to fly pole 260. Elastic cord 244 is made out of a stretchable material (such as a "bungy" cord or the like) and is configured to store mechanical energy to bias fly 206 in a substantially extended (or closed) position.

Fly pole 260 couples with grommets 246*b* of straps 240 which extend from mid-points 230 of shell 204. Fly pole 260 includes a plurality of substantially straight segmented poles or tubes made from a rigid material (e.g., aluminum, plastic, etc.) and connected by an elastic or "bungy" cord.

Fly 206 also includes a pull cord 250 configured to provide the tent occupant with an operative interface with fly 206. One end 251 of pull cord 250 is attached to a ring 242 (which is sewn or stitched to fly 206). Pull cord 250 lays across roof 2102 of shell 204 and crossed poles 208*a*, 208*b* of frame 202, and passes through a grommetted aperture 254 in roof 212 of shell 204 such that another end 255 of pull cord 250 is disposed inside of shell 204. According to a preferred embodiment, grommetted aperture 254 is located immediately adjacent to the intersection of poles 208*a* and 208*b* so that force imparted by pull cord 250 when retracting fly 206 is distributed throughout frame 202.

Tent 200 is assembled by inserting poles 208*a*, 208*b* into sleeves 216, 222 and inserting pole 208*c* into sleeve 228. Each of poles 208*a*, 208*b* is flexed such that ends 256 are inserted into grommets 246*b* of straps 240 of corners 218, 220, 224, 226. Pole 208*c* is flexed so that ends 258 of pole 208*c* are inserted into grommets 246*a* of straps 240 at mid-points 230 of shell 204.

Fly pole 260 is inserted into a sleeve 262, which is attached to fly 206. Fly is positioned upon shell 204 and coupled to shell 204 with clips 242. Fly pole 260 is flexed such that an end 264 is inserted into grommet 246*b* of strap 240 at one of mid-points 230, and an end 266 is inserted into grommet 246*b* of strap 240 at the other of mid-points 230.

To retract fly 206, the occupant inside tent 200 pulls on pull cord 250 pivoting fly 206 about mid-points 230 (toward grommetted hole 254 in roof 212), and stretching elastic cord 244. Poles 208*a*, 208*b* of frame 202 provide a bearing surface for pull cord 250 as the user pulls the pull cord 250 and fly 206 retracts. When fly 206 is in the desired (retracted) position, vents 232 improve ventilation and provide a "window" or "skylight" for persons inside of tent (e.g., for star gazing). After fly 206 is retracted to a desired point, the user adjusts an adjustable grip (not shown) to secure pull cord 250 and retracted fly 206 in a static position. When the user wishes to close fly 206, the user adjusts the adjustable grip to allow the tension in the stretched elastic cord 244 to contract and withdraw pull cord 250 from interior of tent 200.

According to alternative embodiments, the poles, sleeves, straps and cords may be made from any number of a variety materials and have any number of different arrangements and configurations to provide the user with an article configured to manipulate the position of the fly.

According to a preferred embodiment, the straps are made from woven nylon, the shell and the fly are made from nylon sheets, thread for stitching or sewing components is made from nylon or polyester, the vents are made from nylon mesh or netting, the window is made from any of a variety of clear plastic materials, the hub is molded from plastic, poles are made from aluminum tubes, the ring and key are made from metals (e.g., aluminum) or plastic, and the clips are made from molded plastic or metal.

According to alternative embodiments, the actuation mechanism may have any of a variety of configurations for selectively moving fly 16 between a substantially extended position and a substantially retracted position for exposing/uncovering a portion of the tent 11. For example, fly 16 may include alternative ways of pivoting fly 16 (e.g., a swiveling member with grommets configured to receive fly pole 94). Alternatively, base 96 of pivot mechanism 92 may be attached at one end so that the other end is free to twist or rotate with fly pole 94.

Figure 21:
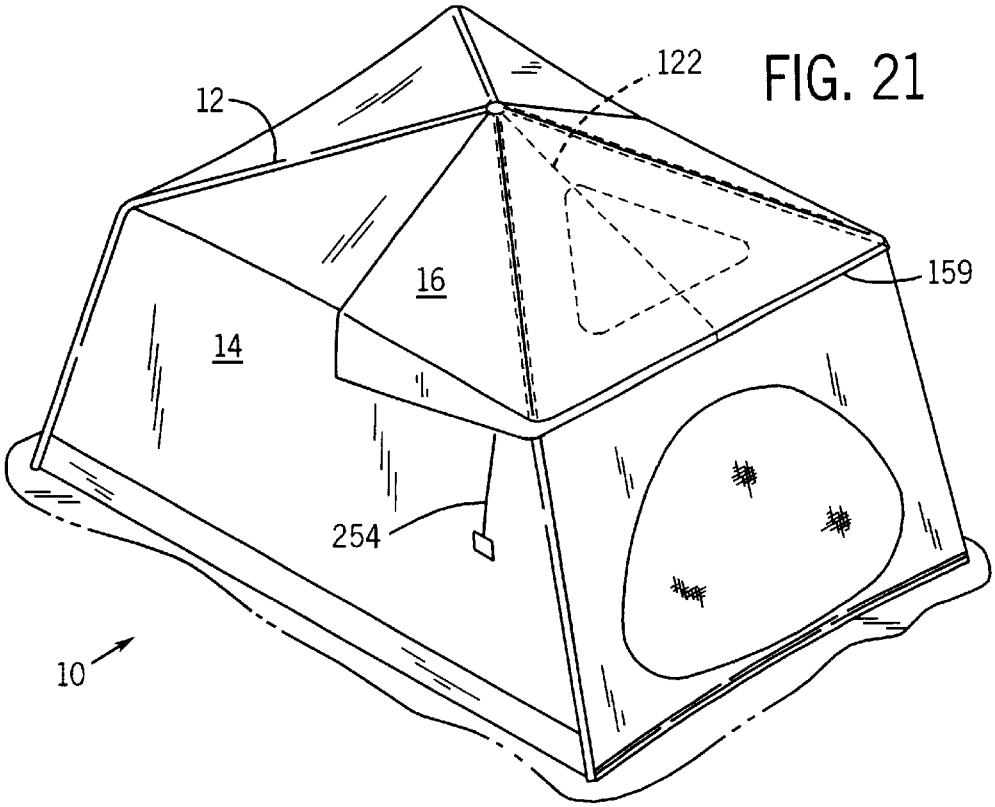
FIGS. 21 and 22 are schematic perspective views of an alternative embodiment of the tent of FIG. 1.
Figure 22:
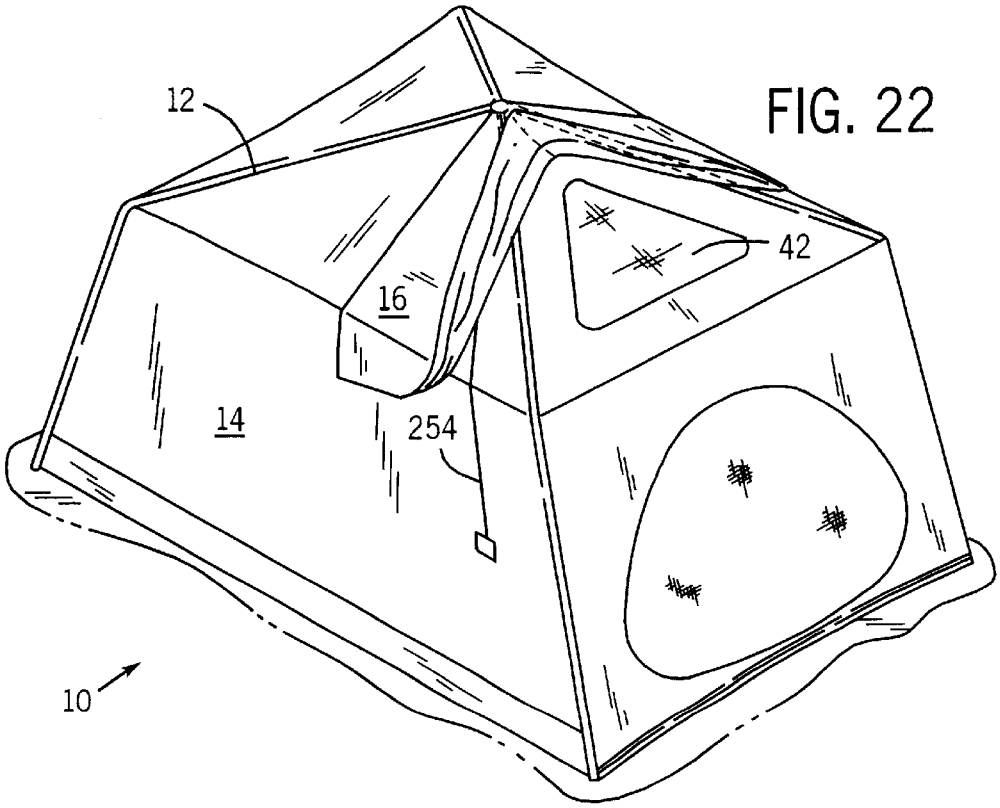
Figure 23:
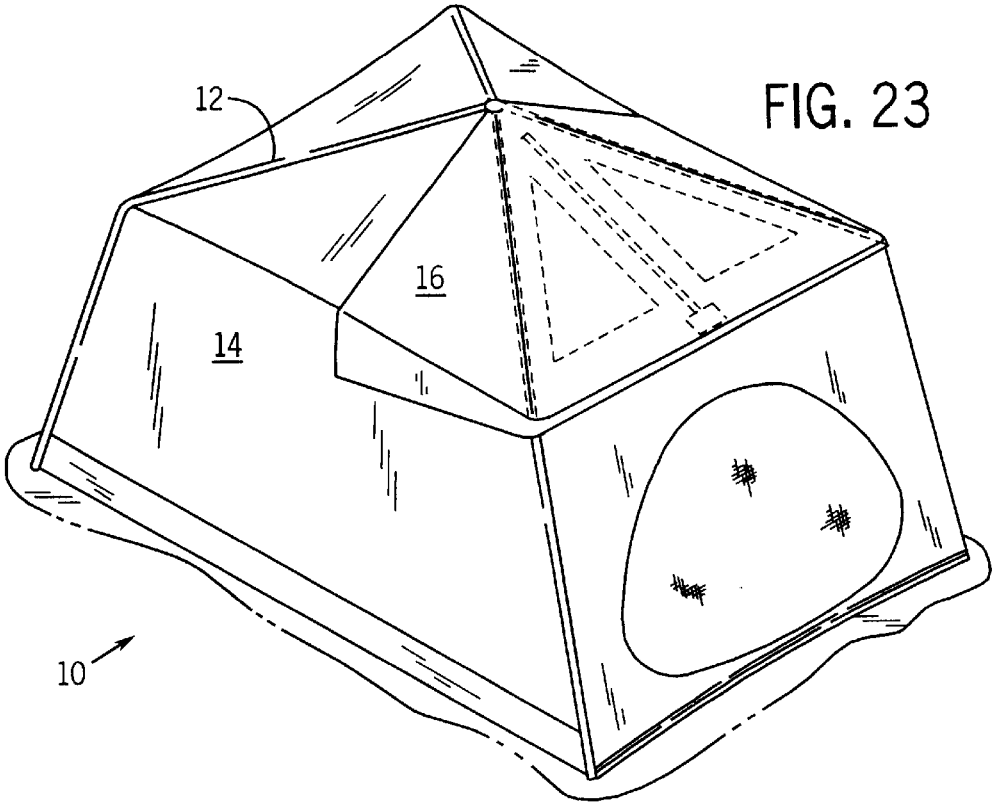
FIGS. 23 and 24 are schematic perspective views of an alternative embodiment of the tent of FIG. 1.
Figure 24:
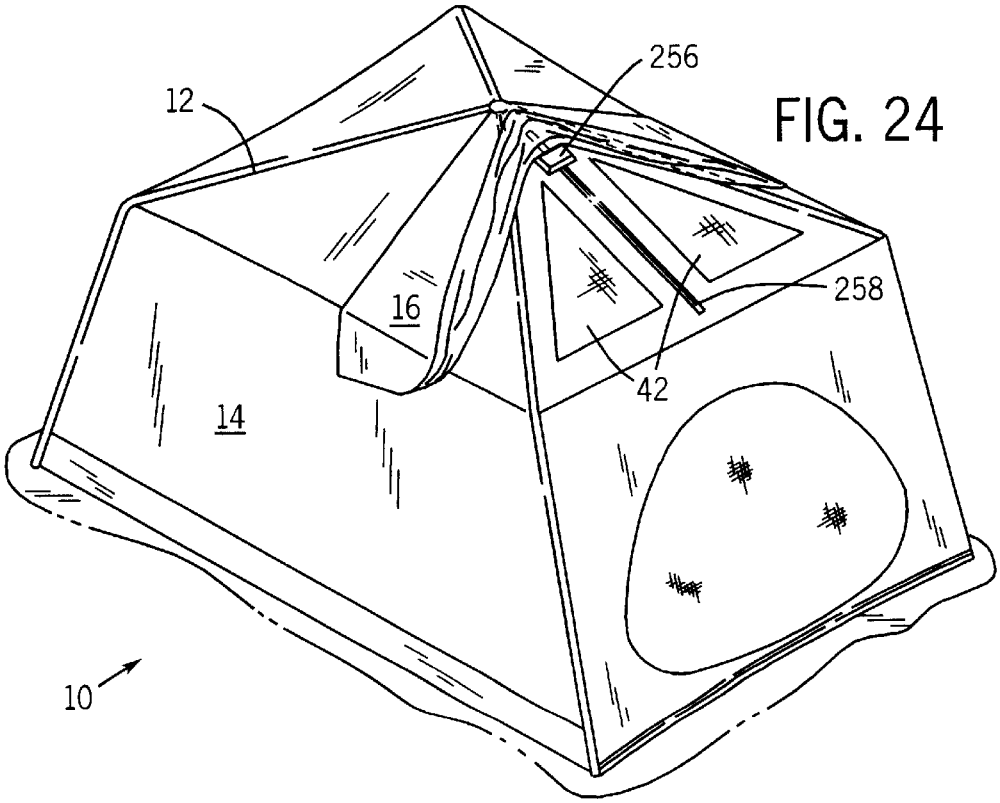

According to an alternative embodiment, fly 16 may be configured to expose a portion of shell 14 by sliding along frame 12 or shell 104 when the occupant operates the actuation interface thereby eliminating the pivot point and/or pivot pole. As shown in FIGS. 21 and 22, a pair of elastic cords 254 attached to shell 14 may be provided to bias the fly in the substantially extended position. When the occupant pulls on pull cord 122, elastic cords 254 are stretched and fly 16 is slid along tent 101 (and bunched up near the center of tent 11) to uncover or expose a portion of shell 14. When occupant allows pull cord 122 to feed out, elastic cords 154 pull fly 16 back over shell 14 to cover up the potion of tent 11 previously exposed. Alternatively, as shown in FIGS. 23 and 24, one or more couplings 256 may be provided and configured to slidably cooperate with one or more tracks 258 attached to frame 12 or shell 14. Alternatively, fly 16 or edge 259 is made of a material having elastic properties and configured to stretch to expose portal 48 (thereby eliminating elastic cords 154). As such, fly 16 may be biased in the extended position so that when the occupant pull on pull cord 122, fly 16 or edge 1059 stretches as shell 14 is exposed.

Figure 25:
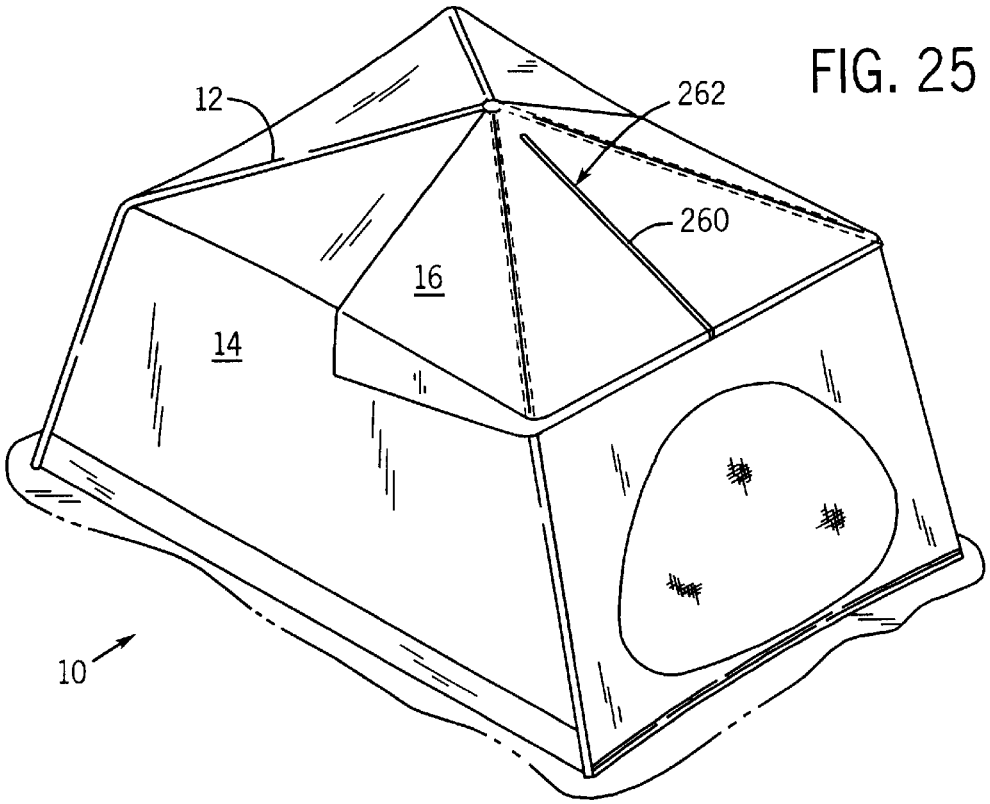
FIG. 25 is a schematic perspective view of an alternative embodiment of the tent of FIG. 1
Figure 26:
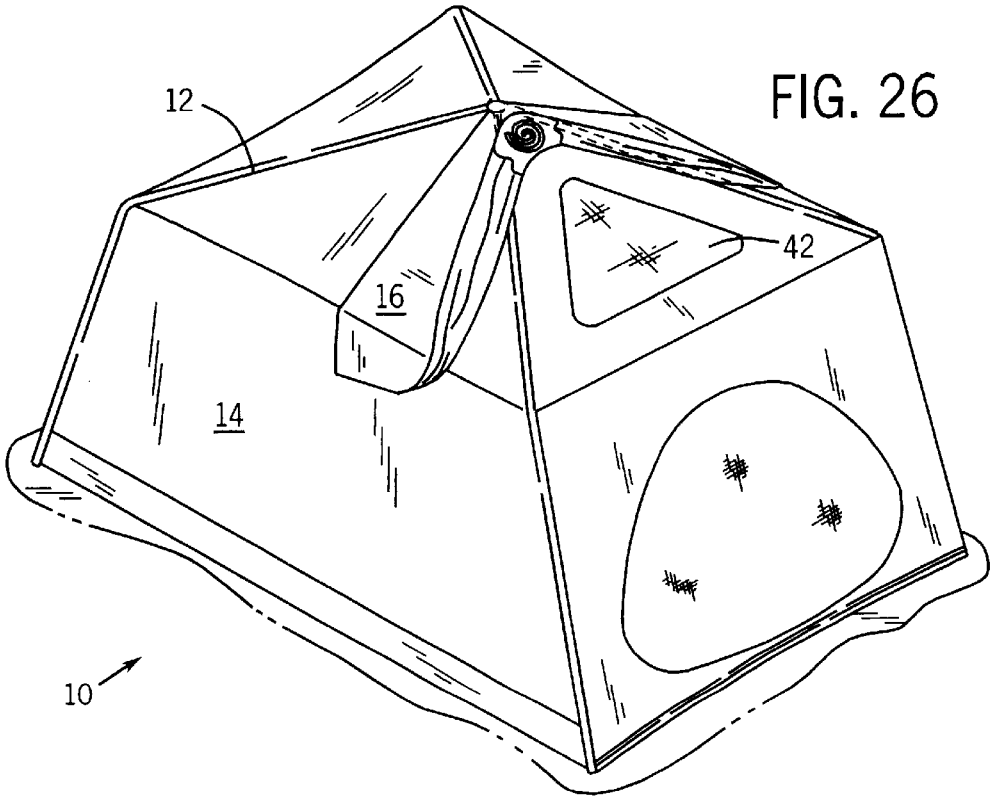
FIG. 26 is a schematic fragmentary perspective view of the tent of FIG. 25.

According to an alternative embodiment shown in FIGS. 25 and 26, one or more flexible bands 260 having a desired spring coefficient may be provided in sleeves 262 attached to fly 16 and biased to place retractable sheet 106 in the extended or the retracted position so that manipulation of the actuation device (e.g., pull cord 122) by the tent occupant causes retractable sheet 106 to be rolled or unrolled, which may be "undone" due to stored mechanical energy in the bands.

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, or use of materials) without materially departing from the novel teachings and advantages of the invention. For example, instead of providing a separate fly, a portion of the shell may be configured to be selectively adjusted by a person inside of the tent. Accordingly, all such modifications are intended to be included within the scope of the invention as defined in the appended claims. Other substitutions, modifications, changes and omissions may be made in the design, operating conditions and arrangement of preferred embodiments without departing from the spirit of the invention as expressed in the appended claims.

What is claimed is:

1. A tent system comprising:

a tent including a shell and a frame configured to support the shell;

a sheet disposed substantially outside of shell and adjustably coupled to the tent, wherein the sheet may adjust between a substantially extended position, which overlies at least a portion of the shell, and a substantially retracted position, which exposes at least a portion of the shell, by a person substantially inside of the tent;

a biasing member configured to bias the sheet in one of the substantially extended position and the substantially retracted position;

wherein the sheet includes an actuation interface coupled to the sheet and configured to actuate the sheet between the substantially extended position and the substantially retracted position from inside of the shell;

wherein the actuation interface includes a cord wherein a first end of the cord is coupled to the sheet and a second end of the cord is disposed inside the shell;

a locking device coupled to the cord, wherein the locking device is coupled to the shell.

2. The tent system of claim 1 wherein the sheet is resiliently biased in the substantially extended position.

3. The tent system of claim 1 wherein the biasing member is an elastic cord coupled to the sheet and the shell.

4. The tent system of claim 3 wherein the elastic cord biases the sheet in the substantially extended position.

5. The tent system of claim 1 wherein the shell includes a portal which is substantially covered by the sheet when the sheet is in the substantially extended position.

6. The tent system of claim 5 wherein the portal is substantially uncovered by the sheet when the sheet is in the substantially retracted position.

7. The tent system of claim 5 wherein the portal is a mesh netting.

8. The tent system of claim 1 further including a pole coupled to the shell.

9. The tent system of claim 8 wherein the sheet includes a sleeve configured to receive the pole.

10. The tent system of claim 1 further including an actuation mechanism coupled to the shell.

11. The tent system of claim 10 wherein the sheet is configured to pivot about the actuation mechanism between the substantially extended position and the substantially retracted position.

12. The tent system of claim 11 wherein the actuation mechanism includes a pivot member coupled to the actuation mechanism.

13. The tent system of claim 10 wherein the actuation mechanism is located at an end of the tent.

14. The tent system of claim 10 wherein the actuation mechanism is located at approximately mid points of the shell.

15. The tent system of claim 10 wherein the actuation mechanism is a strap having a first end coupled to the shell and a second end coupled to the sheet.

16. The tent system of claim 15 wherein the sheet includes a pole coupled to the sheet and the strap includes a grommet configured to receive an end of the pole.

17. The tent system of claim 10 wherein the actuation mechanism includes a band which is coiled when the sheet is in the substantially retracted position.

18. The tent system of claim 10 wherein the actuation mechanism includes a track coupled to the sheet and includes a coupling coupled to the sheet and slidably coupled to the track, whereby the coupling slides along the track to adjust the sheet between the substantially extended position and the substantially retracted position.

19. The tent system of claim 1 wherein the sheet is integrally formed with the shell.

20. The tent system of claim 1 wherein the sheet is positionable at any point between the substantially extended position and the substantially retracted position.

21. The tent system of claim 1 wherein the sheet extends out over an end of the tent.

22. The tent system of claim 1 further comprising a coiled band coupled to the sheet and configured to resiliently bias the sheet in the retracted position.

23. The tent system of claim 1 further comprising a track coupled to the tent, and a coupling coupled to the sheet and slidably coupled to the track.

24. The tent system of claim 1 wherein the sheet is biased continuously between the substantially extended position and the substantially retracted position.

25. A tent system comprising:

a tent including a shell and a frame configured to support the shell;

a sheet disposed substantially outside of shell and adjustably coupled to the tent, wherein the sheet may adjust between a substantially extended position, which overlies at least a portion of the shell, and a substantially retracted position, which exposes at least a portion of the shell, by a person substantially inside of the tent;

a biasing member configured to bias the sheet in one of the substantially extended position and the substantially retracted position;

an actuation mechanism coupled to the shell;

wherein the sheet includes a pole coupled to the sheet and the actuation mechanism includes a grommet configured to receive an end of the pole.

26. The tent system of claim 25 wherein the sheet includes an actuation interface coupled to the sheet and configured to actuate the sheet between the substantially extended position and the substantially retracted position from inside of the shell.

27. The tent system of claim 26 wherein the actuation interface includes a cord wherein a first end of the cord is coupled to the sheet and a second end of the cord is disposed inside the shell.

28. The tent system of claim 6 further including a locking device coupled to the cord.

29. The tent system of claim 28 wherein the locking device is coupled to the shell.

30. The tent system of claim 26 wherein the actuation interface extends through the shell.

31. The tent system of claim 25 wherein the actuation mechanism includes a strap having a first end coupled to the shell and a second end coupled to the sheet.

32. The tent system of claim 31 wherein the pole is coupled to the sheet and the strap includes a grommet configured to receive an end of the pole.

33. A tent system comprising:

a tent including a shell and a frame configured to support the shell;

a sheet disposed substantially outside of the shell and adjustably coupled to the tent, wherein the sheet may adjust between a substantially extended position, which overlies at least a portion of the shell, and a substantially retracted position, which exposes at least a portion of the shell, by a person substantially inside of the tent;

wherein the frame is disposed on the outside of the shell and configured to provide space between the sheet and the shell.

34. The tent system of claim 33 wherein the sheet includes an actuation interface coupled to the sheet and configured to actuate the sheet between the substantially extended position and the substantially retracted position from inside of the shell.

35. The tent system of claim 33 further including an actuation mechanism coupled to the shell, wherein the sheet is configured to pivot about the actuation mechanism between the substantially extended position and the substantially retracted position.

36. The tent system of claim 33 wherein the sheet is positionable at any point between the substantially extended position and the substantially retracted position.

37. The tent system of claim 33 wherein the sheet is biased continuously between the substantially extended position and the substantially retracted position.

38. A covering for a tent, the tent including a shell and a frame configured to support the shell, the covering comprising:

a sheet adapted to be adjustably coupled to the tent wherein the sheet may adjust between a substantially extended position and a substantially retracted position by a person inside of the tent a biasing member configured to bias the sheet in one of the substantially extended position and the substantially retracted position;

a coiled band coupled to the sheet and configured to resiliently bias the sheet in the retracted position.

39. The covering of claim 38 wherein the sheet is resiliently biased in the substantially extended position when coupled to the tent.

40. The covering of claim 38 further comprising an elastic cord adapted to be coupled to the sheet and the shell.

41. The covering of claim 40 wherein the elastic cord biases the sheet in the substantially extended position.

42. The covering of claim 38 wherein the sheet includes an actuation interface configured to actuate the sheet between the substantially extended position and the substantially retracted position from inside of the shell.

43. The covering of claim 42 wherein the actuation interface includes a cord wherein a first end of the cord is coupled to the sheet and a second end of the cord is adapted to be disposed inside the shell.

44. The covering of claim 43 further including a locking device coupled to the cord.

45. The covering of claim 44 wherein the locking device is adapted to be coupled to the shell.

46. The covering of claim 38 wherein the sheet is configured to uncover a portion of the shell when in the substantially extended position.

47. The covering of claim 38 further including a pole for providing support to the sheet adapted to be coupled to the shell.

48. The covering of claim 47 wherein the sheet includes a sleeve configured to receive the pole.

49. The covering of claim 38 further including an actuation mechanism operatively coupled to the sheet and adapted to be coupled to the shell.

50. The covering of claim 49 wherein the sheet is configured to pivot about the actuation mechanism and between the substantially extended position and the substantially retracted position.

51. The covering of claim 50 wherein the actuation mechanism includes a pivot member coupled to the actuation mechanism.

52. The covering of claim 49 wherein the actuation mechanism is adapted to be located at an end of the tent.

53. The covering of claim 49 wherein the actuation mechanism is adapted to be located at approximately a mid point of the shell.

54. The covering of claim 49 wherein the sheet includes a pole coupled to the sheet and the actuation mechanism includes a grommet configured to receive an end of the pole.

55. The covering of claim 49 wherein the actuation mechanism is a strap having a first end coupled to the shell and a second end coupled to the sheet.

56. The covering of claim 55 further including a pole adapted to be coupled to the sheet and the strap includes a grommet configured to receive an end of the pole.

57. The covering of claim 38 wherein the sheet is adapted to be integrally formed with the shell.

58. The covering of claim 38 wherein the sheet is adapted to be extended out over an end of the tent.

59. The tent system of claim 38 further comprising a coiled band coupled to the sheet and configured to resiliently bias the sheet in the retracted position.

60. A covering for a tent, the tent including a shell and a frame configured to support the shell, the covering comprising:

a sheet adapted to be adjustably coupled to the tent wherein the sheet may adjust between a substantially extended position and a substantially retracted position by a person inside of the tent;

wherein the sheet is a fly configured to be coupled to the shell and the fly includes a first sheet and a second sheet coupled to the first sheet.

61. The covering of claim 60 wherein the second sheet adjusts between the substantially extended position and the substantially retracted position.

62. The covering of claim 60 wherein the first sheet includes an aperture configured to expose a portion of the shell.

63. The covering of claim 62 further including an actuation mechanism adapted to be coupled to the shell located adjacent to the aperture.

64. The covering of claim 60 wherein the second sheet adjusts between the substantially extended position and the substantially retracted position.

65. The covering of claim 60 wherein the first sheet includes an aperture adapted to expose a portion of the shell.

66. The covering of claim 65 further including an actuation mechanism adapted to be coupled to the shell located adjacent to the aperture.

67. The covering of claim 65 wherein the shell is adapted to provide a portal disposed adjacent to the aperture.

68. A covering for a tent, the tent including a shell and a frame configured to support the shell, the covering comprising:

a sheet adapted to be adapted to be adjustably coupled to the tent wherein the sheet may adjust between a substantially extended position and a substantially retracted position by a person inside of the tent a biasing member configured to bias the sheet in one of the substantially extended position and the substantially retracted position;

a track adapted to be coupled to the tent, and a coupling coupled to the sheet and slidably coupled to the track.

69. The covering of claim 68 wherein the coupling is configured to slide along the track to adjust the sheet between the substantially extended position and the substantially retracted position.

70. The covering of claim 68 wherein the sheet adjusts between the substantially extended position and the substantially retracted position.

71. A method for selectively adjusting a fly from inside a tent relative to an underlying shell, the method including the steps of:

applying a biasing force to urge the fly towards one of a substantially extended position and a substantially retracted position;

providing a cord having a first end attached to the fly and a second end disposed inside the tent; and actuating the position of the fly by adjusting the length of cord disposed inside the tent;

wherein the actuating step includes pivoting the fly between a substantially extended position and a substantially retracted position.

72. The method of claim 71 further comprising the step of releasing a locking mechanism from its securement at a first position on a cord which is attached at one end to the fly.

73. The method of claim 72 further comprising the step of repositioning the locking mechanism to a second position on the cord.

74. The method of claim 73 further comprising the step of reactivating the locking mechanism.

75. The method of claim 71 wherein the actuating step includes allowing the cord to be feed out of the shell.

76. The method of claim 71 wherein the actuating step includes sliding the fly between a substantially extended position and a substantially retracted position.

77. The method of claim 71 wherein the biasing force is sufficient to move the sheet to one of the substantially extended position and the substantially retracted position absent a countervailing force.

78. The method of claim 77 wherein the countervailing force is provided by a locking device.

79. A method for selectively adjusting a fly from inside a tent relative to an underlying shell, the method including the steps of:

applying a biasing force to urge the sheet towards one of a substantially extended position and a substantially retracted position;

providing a cord having a first end attached to the fly and a second end disposed inside the tent; and actuating the position of the fly by adjusting the length of cord disposed inside the tent;

wherein the actuating step includes pulling the cord so that the fly pivots in a retracting manner.

80. The method of claim 79 wherein the actuating step includes pivoting the fly between a substantially extended position and a substantially retracted position.

81. The method of claim 79 wherein the biasing force is sufficient to move the sheet to one of the substantially extended position and the substantially retracted position absent a countervailing force.

* * * * *